US007631396B2

(12) United States Patent
Ivarsson et al.

(10) Patent No.: US 7,631,396 B2
(45) Date of Patent: Dec. 15, 2009

(54) SUCTION CLEANERS

(75) Inventors: Bengt Ivar Anders Ivarsson, Smethwick (GB); Gavin Burnham, Birmingham (GB); Reuben Proud, Worcester (GB)

(73) Assignee: Techtronic Industries Company Limited, Tsuen Wan, N.T. (HK)

( * ) Notice: Subject to any disclaimer, the term of this patent is extended or adjusted under 35 U.S.C. 154(b) by 644 days.

(21) Appl. No.: 11/018,552

(22) Filed: Dec. 22, 2004

(65) Prior Publication Data

US 2005/0144754 A1 Jul. 7, 2005

(30) Foreign Application Priority Data

Dec. 23, 2003 (GB) ..... 0329770.2

(51) Int. Cl.
*A47L 5/36* (2006.01)

(52) U.S. Cl. ..... 15/414; 15/327.2

(58) Field of Classification Search ..... 15/414, 15/315, 323, 327.1, 327.2
See application file for complete search history.

(56) References Cited

U.S. PATENT DOCUMENTS

| | | | | |
|---|---|---|---|---|
| 2,867,833 | A * | 1/1959 | Duff | 15/323 |
| 3,486,532 | A | 12/1969 | Shigeji | |
| 3,520,725 | A * | 7/1970 | Hamrick | 134/21 |
| 3,599,273 | A | 8/1971 | Konomu | |
| 3,682,500 | A * | 8/1972 | Hamrick | 285/7 |
| 3,911,944 | A * | 10/1975 | Hukuba et al. | 137/355.2 |
| 5,584,436 | A * | 12/1996 | Sepke | 239/154 |
| 7,145,074 | B2 * | 12/2006 | Henkin et al. | 210/167.1 |
| 2001/0002500 | A1 | 6/2001 | Kasen | |
| 2002/0092103 | A1 | 7/2002 | Bruno | |
| 2005/0022338 | A1 * | 2/2005 | Muhlenkamp | 15/414 |
| 2005/0050675 | A1 * | 3/2005 | Hsu | 15/344 |
| 2005/0188496 | A1 * | 9/2005 | Small et al. | 15/323 |

FOREIGN PATENT DOCUMENTS

| | | | |
|---|---|---|---|
| AT | 399 816 | B | 7/1995 |
| DE | 295 00 944 | A | 5/1996 |
| DE | 298 16 382 | U1 | 11/1998 |
| GB | 2388527 | A * | 11/2003 |
| WO | WO 03/024294 | | 3/2003 |

OTHER PUBLICATIONS

European Search Report for related EP Application No. EP 04 03 0487 dated Apr. 26, 2006.

* cited by examiner

*Primary Examiner*—David B Thomas
(74) *Attorney, Agent, or Firm*—Michael Best & Friedrich LLP

(57) ABSTRACT

A suction cleaner comprising a suction unit having a source of suction and a separator/collector arrangement for separating entrained dirt from a flow of air created by the source of suction and for collecting and retaining such separated dirt for disposal; and a flexible suction hose for conveying suction airflow to the suction unit from a hose inlet at which a cleaning tool may be connected; wherein the suction hose comprises a first portion which can be accommodated in the suction unit and deployed therefrom when required and which is extendible in length when subject to lengthways tension, and a second portion having the inlet and connected to the first hose portion.

11 Claims, 3 Drawing Sheets

SUCTION CLEANERS

CROSS-REFERENCE TO RELATED APPLICATION

This application claims the priority of British Patent Application No. 0329770.2 filed Dec. 23, 2003, the subject matter of which is incorporated herein by reference.

BACKGROUND TO THE INVENTION

1. Field of the Invention

This invention relates to a suction cleaner (vacuum cleaner), having a suction hose which connects to the suction unit and has an inlet at which dirt-laden air may be inducted, e.g. by the connection of the inlet to a wand and/or a cleaning tool.

2. Background to the Invention

The invention has been devised in relation to a suction cleaner of the so-called "cylinder" type. This type of cleaner comprises a suction unit having a source of suction (a motor and impeller) and a separator/collector arrangement, for separating entrained dirt from the flow of air created by the source of the suction and for collecting and retaining such separated dirt for appropriate disposal. The separator/collector may include one or more filters for removing entrained dirt from the airflow and/or one or more "cyclonic" separators in which the separation is effected by centrifugal force. In use the suction unit is positioned in the vicinity of where a cleaning operation is being carried out, and a flexible suction hose connects the suction unit to a cleaning tool being wielded by a person carrying out the cleaning. For floor cleaning and for cleaning some other surfaces, the cleaning tool usually is connected at the end of an elongate rigid wand, possibly telescopically extendible and contractible, whose other end is connected to the suction hose.

Usually the suction hose is detachable from the suction unit, and when the cleaner is not in use the suction hose may be stored wherever is convenient. It is known that a suction unit can be provided with external formations on which the suction hose can be arranged, e.g. coiled, for storage. Possibly the hose may even remain connected to the suction unit when thus stored. However, such storage of a hose is generally inconvenient. A hose of reasonable length is bulky and vulnerable to damage when stored. It has also been proposed that the suction unit of a suction cleaner may be provided with internal storage, e.g. in the form of a drum on which the hose can be coiled and stored within the unit, to be deployed therefrom when required. However such arrangements as proposed hitherto have been bulky, and thus inconvenient, and have had other disadvantages including the necessity of providing complex mechanisms for controlling the operation of the drum and the coiling of the hose thereon.

Certain cleaning operations make it desirable that a suction cleaner should be provided with a relatively long hose, e.g. four metres or possibly even longer. This facilitates the cleaning of a stairway, with the suction unit being positioned at the top or bottom of the stairway. However a hose of this length is even more difficult to accommodate either inside or outside the suction unit.

Apart from the cylinder type of suction cleaner, the other main type of cleaner is the "upright" type, in which a cleaning head is provided as part of a generally upstanding suction unit, the whole cleaner being manoeuvrable over a floor surface by an operator grasping a handle on the suction unit. It is known that such a cleaner may have a suction hose either provided on the suction unit and able to be deployed for use with other cleaning tools, or possibly as a separate component to be attached to the suction unit for use with cleaning tools other than the floor cleaning head. Although primarily intended for use with a cleaner of the cylinder type, the present invention may also be applicable for use with an upright type of cleaner having a suction hose.

SUMMARY OF THE INVENTION

It is broadly the object of the present invention to provide a suction cleaner, which may be of the cylinder type, with a hose arrangement which provides the advantage of a long hose, usable e.g. as above described, whilst overcoming or reducing the disadvantages associated with conventional arrangements for hose storage. According to one aspect of the present invention, we provide a suction cleaner comprising a suction unit for creating a flow of air for drawing in dirt, a flexible suction hose leading from the suction unit and having a hose inlet at which the suction air flow may be drawn in, the suction hose comprising a first hose portion and a second hose portion having a connection to the first hose portion, the second hose portion having the hose inlet, wherein the first hose portion is extendible lengthwise when subject to lengthways tension, and wherein the suction unit affords a storage volume for accommodating the first hose portion when it is in a contracted condition, and from which the first hose portion can be deployed when required.

In a suction cleaner according to the invention, the total length of hose available for use is that of the first and second hose portions together, while when the first hose portion is accommodated in the suction unit only the length of hose constituting the second hose portion needs to be stored externally of the suction unit. Thus the disadvantage of having to store a very long length of hose externally of the suction unit is largely avoided. At the same time, since only the first portion of the hose is required to be accommodated in the suction unit, a relatively simple arrangement for storing the first portion in the suction unit can be adopted. Thus the problems associated with previously known arrangements for internal storage of a long length of suction hose in the suction unit are largely overcome.

Hoses are available for the first hose portion which are capable of being extended up to about six times their length when contracted. Thus a relatively short length of such hose, which can relatively easily be accommodated in a storage volume of a cleaner suction unit, can provide a much greater usable length of hose when deployed therefrom. For example, a length of up to about 0.5 metre of such hose when contracted, which can relatively easily be accommodated in the suction unit, can be extended and deployed to a free length of 2.5-3 metres (allowing for a length of the extended hose remaining within the storage volume of the suction unit).

The second portion of the hose may be a conventional (substantially non-extendible) hose, of a length of the order of 2 metres of so. Non-extendible hose is substantially less expensive than extendible hose, and such hose, especially a relatively short length thereof, is less vulnerable to damage when stored externally of the suction unit. It will be appreciated that a suction cleaner in accordance with the invention may readily achieve a total usable hose length of the order of 5 metres, which is more than adequate for most domestic cleaning tasks.

The first portion of the hose may be arranged to be accommodated in the storage volume of the suction unit in a generally sinuous configuration. There may be at least one guide formation for causing it to assume a generally S-shaped configuration within the storage volume.

There may be a pivotable member having spaced guide formations which cause the hose portion to assume its S-shaped configuration. The formations may comprise rollers, and the pivotable member may be spring biased to pivot in the sense to cause the hose portion to assume the generally S-shaped configuration. Alternatively, there may be a slidable guide formation such as a roller.

The free end of the first hose portion may be releasably connected to the second hose portion. Such a connection may be semi-permanent, in the sense that it is intended only to be disconnected if it is required, for example, to remove a blockage from the hose in the vicinity of the connection, or may be readily disconnectable when required, e.g. by a bayonet fitting or any other expedient known for use in disconnectable hose connections in suction cleaners.

The connection of the second hose portion to the first hose portion may be releasably connectable to a body part of the suction unit, e.g. by a bayonet or clip connection. Thus, when the first hose portion is not deployed, the second hose portion can be connected to the suction unit in such a way that the suction unit can be moved by pulling on the second hose portion.

BRIEF DESCRIPTION OF DRAWINGS

These and other features of the invention will now be described by way of example with reference to the accompanying drawings, of which.

DESCRIPTION OF PREFERRED EMBODIMENTS

Figure 1:
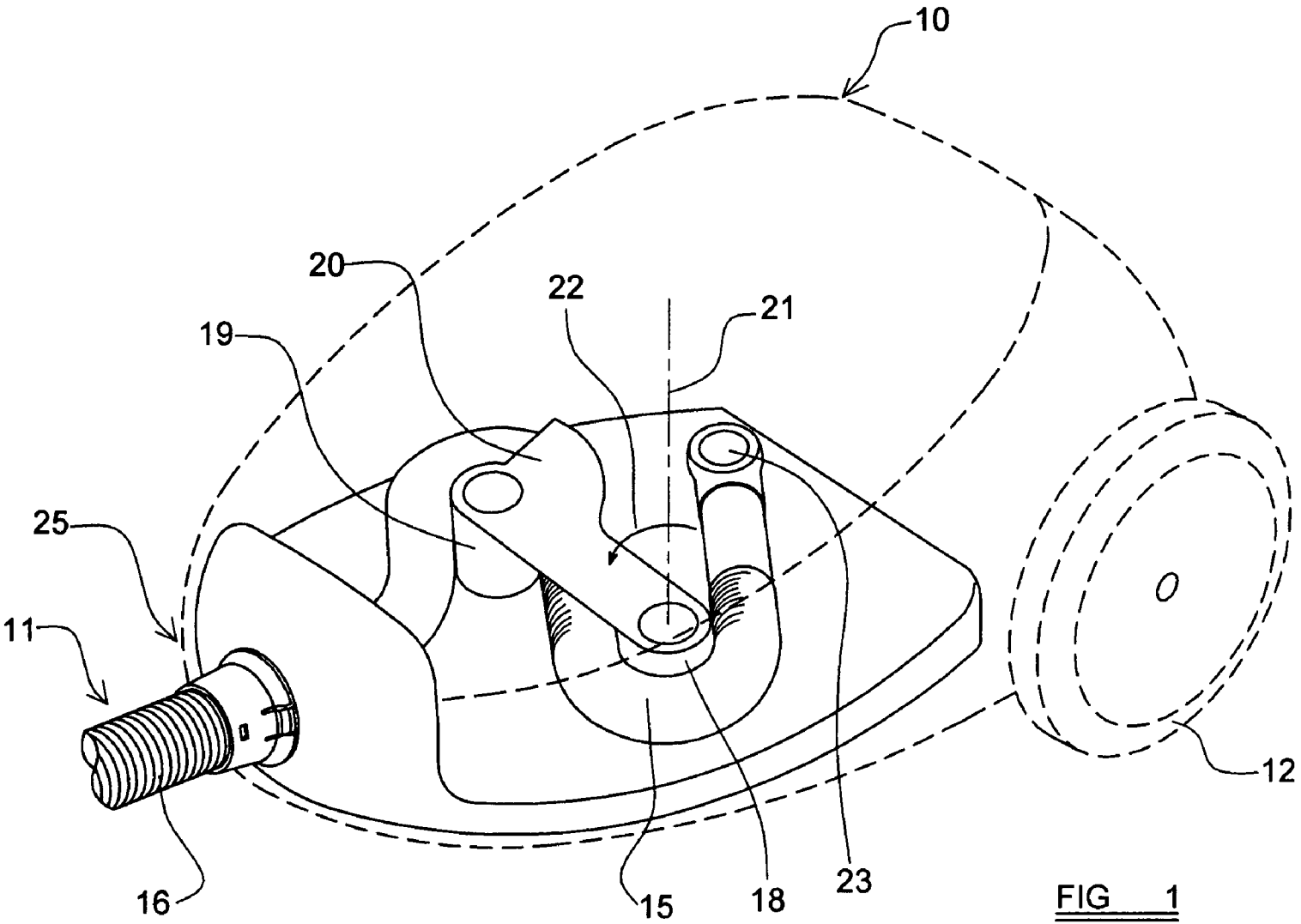
FIG. 1 is a diagrammatic perspective view of a suction cleaner in accordance with the invention, showing the accommodation of a first hose portion therein.

Referring firstly to FIG. 1 of the drawings, this shows in outline only a body 10 of a suction unit of a suction cleaner of the cylinder type. A suction hose indicated generally at 11 extends from one end, herein called the front end of the body 10, for connection to a cleaning tool (or the free end of the suction hose may be used to suck up dirt directly without a cleaning tool). For some cleaning jobs, e.g. cleaning floors, a cleaning tool is usually connected to the hose with the intermediary of a rigid, possibly telescopically extendible and contractible, wand. All this is conventional. At the opposite (rear) end of the body 10 to that from which the hose 11 extends, the body has wheels as indicated diagrammatically at 12, a corresponding wheel at the opposite side of the body 10 from the wheel 12 not being shown in the drawing. Typically there may be another wheel, e.g. a castor, not shown beneath the body 10 towards the front end thereof, so that the suction unit can easily be moved over a floor surface on its wheels.

The suction unit is provided, within its body 10, with a source of suction, i.e. a motor and impeller which may be disposed in the space between the wheels as 12. It also has a separator/collector arrangement, for separating entrained dirt from the flow of air created by the source of suction and for collecting and retaining such separated dirt for later disposal. The separator/collector may include one or more filters and/or one or more cyclonic separators. All this is well known to those skilled in the art of suction cleaners.

The suction hose as indicated generally at 11 comprises a first hose portion 15 and a second hose portion 16. The first hose portion 15 is a length of a known type of hose which is extendible lengthwise when subject to tension. For example this hose portion may be capable of being extended up to about six times its length when contracted or possibly a greater extension, and is resilient so that it contracts when free of tension. The second hose portion 16 is a conventional substantially non-extendible length of suction cleaner hose, and extends to an inlet (not shown) at which a cleaning tool may be connected, possibly by way of a wand.

In referring to the second hose portion as being substantially non-extendible, it will be understood that as suction hoses are usually constructed of plastics materials, a hose which is intended to be extendible in normal use will be able to be extended to some degree if subject to sufficient lengthways tension. This is unlikely to be encountered in normal circumstances, to which we are referring when using the term "substantially inextendible".

The first hose portion 15 is arranged, when contracted, to be accommodated in a storage chamber within the body 10 of the cleaner suction unit. As diagrammatically shown in FIG. 1, the storage chamber occupies a space in the front lower body part of the suction unit, adjacent where the hose extends therefrom. When fully accommodated within the storage chamber, the contracted first hose portion assumes a sinuous, somewhat S-shaped configuration and there is guide means for causing it to assume this configuration.

As shown in the drawing, the guide means may comprise two guide formations in the form of rollers 18, 19, spaced from one another and of a diameter such that when the hose extends around the circumference of the roller it is restrained from kinking or bending in too small a radius which might restrict its interior airflow passage. The roller 19 is carried by an arm 20 which is pivotable about an axis 21 which is concentric with the roller 18, and the arm is spring biased about the axis 21 towards the position in which it is shown in FIG. 1. It is able to pivot against its spring biasing, about the axis 21, in the direction indicated by arrow 22 and this is what happens when the first hose portion 15 is pulled and extended so as to be deployed from the storage chamber within the body 10. When the hose portion 15 is fully deployed, it adopts a more nearly straight configuration within the storage chamber, although it is still sinuous to some extent as it passes the rollers 18, 19.

Also visible in FIG. 1 is a fitting 23, e.g. an elbow, at an end of the first hose portion 15 fixed within the body 10, connecting the hose portion 15 to an airflow passage leading to the separator/collector arrangement of the suction unit (which may be above the storage chamber accommodating the hose portion 15).

Figure 2:
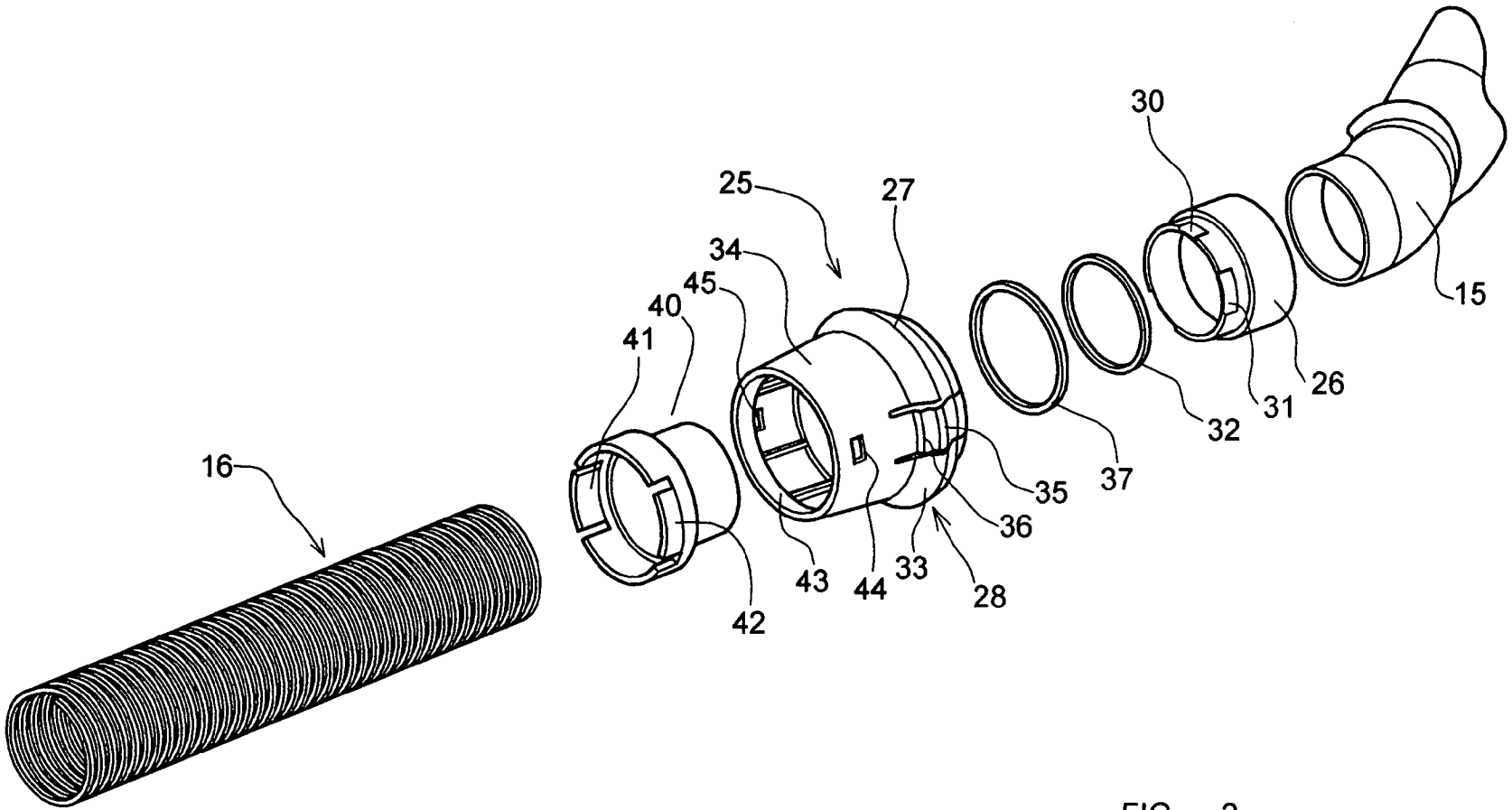
FIG. 2 is a diagrammatic exploded perspective view of a connection between first and second hose portions of the suction cleaner.

The first hose portion 15 is joined to the second hose portion 16 by a connection indicated generally at 25 in FIG. 1 of the drawings and shown in greater detail in FIG. 2. The free end of the first hose portion 15 fits tightly into a cuff 26, and is fixed permanently therein by an adhesive. The cuff 26 engages with the inside of one end portion 27 of a further cuff member 28, and is retained therein in the manner of a bayonet fastening, i.e. it is retained by an angular movement about the common longitudinal axis of the openings extending through the cuffs 26, 28 after having been inserted axially into the cuff 28. For providing such bayonet engagement, four lugs are provided on a front part 29 of the cuff 26, being spaced angularly thereabout and two of such lugs being visible at 30, 31. They are engaged with complementary formations within the part 27 of the cuff member 28. A seal 32 provides substantially air tight sealing between the cuff 26 and cuff 28.

The connection between the cuff 26 and cuff 28 does not allow for relative angular movement therebetween about their common axis (except for that entailed in the establishment of the bayonet connection therebetween). As an alternative to the bayonet connection, a "snap fit" connection could be provided, by suitable formations on the engaging parts which snap into engagement with one another.

The part 27 of the cuff member 28 has an enlarged external circumferential rib 33 and beyond that the cuff member has an externally tapering front part 34. The rear part 27 of the cuff 28 is able to be engaged within an opening at the front of the body 10 of the suction cleaner, to be retained in such engagement and released therefrom when required. For this the parts 27, 33 of the cuff 28 have two diametrically opposed lug parts of which one is visible at 35 in FIG. 2. Free end portions of these lugs as 35, i.e. the ends remote from the front part 34 of the cuff member, are able to snap-engage with a suitable formation in or associated with the opening in the body 10. The lugs 35 may end in projections engageable with the wall of the body behind the opening, and they have portions as indicated at 36 for the lug 35, which can be gripped by a user and squeezed towards one another to disengage the lugs 35 from the body, enabling the cuff 28 to be disconnected from the body of the suction cleaner. The cuff 28 may be manufactured as a moulding of a suitable plastics material, such movement of these lugs 35 being permitted by the resilience of such material.

A further seal 37 is operative between the cuff 28 and the front of the body 10, when the cuff 28 is engaged with the body.

The second hose portion 16 is engaged, as a close fit, in the interior of a collar 40 and is fixed permanently therein by use of adhesive. The collar 40 fits into the front part 34 of the cuff 28, and is held therein as a snap fit, by engagement of diametrically opposed resilient wall parts 41, 42 on the collar 40 behind an undercut lip 43 extending around the interior of the part 34 of the cuff 28 at its free end. The fit of the collar within the cuff is loose enough to allow relative angular movement therebetween about the axis extending centrally through the collar and cuff. The collar 40 is releasable from the cuff 28 e.g. for maintenance purposes (as may be required if a blockage in the first or second hose portion or connection therebetween occurs), and such release may require the use of simple tools such as by pushing the ends of thin narrow implements such as screwdrivers through apertures 44, 45 in the cuff part 34, to engage the flexible wall portions 41, 42 and move them towards one another to be released from behind the lip 43.

When the connector 25 is engaged with the body 10 of the suction unit, the length of suction hose available to be used is that of the second hose portion only. The suction unit may be moved over a floor surface by pulling on the hose portion 16. However, if a longer length of suction hose is required, e.g. for cleaning a stairway, the connector 25 can be disengaged from the body 10, enabling the first hose portion 15 to be pulled outwardly from the storage chamber within the body until it is completely deployed. The total length of suction hose available to the user then comprises the extended length of the first hose portion 15 which lies outside the body, plus the length of the second hose portion 16. When the full length of the hose is no longer required, the first hose portion 15 can contract and be guided back into the storage chamber within the body 10, assisted by the spring biasing of the arm 20 with the rollers 18, 19, until the connector 25 can again be engaged with the body 10.

In the embodiment described, it is not intended that the second hose portion 16 should be regularly disengaged from the first hose portion 15, although as described above the arrangement by which the collar 40 engages with the cuff 28 enables disengagement when required, for example if a hose blockage should occur. However, it is to be appreciated that it would be possible for a more readily disengageable connection to be provided between the two hose portions, so that the hose portion 16 may be removed from the suction unit if required when the suction cleaner is not in use. For example, a bayonet fitting may be provided, or a more readily disengageable snap connection therebetween, or any other arrangement such as is generally known for disconnectible hose connections in suction cleaners.

Figure 3:
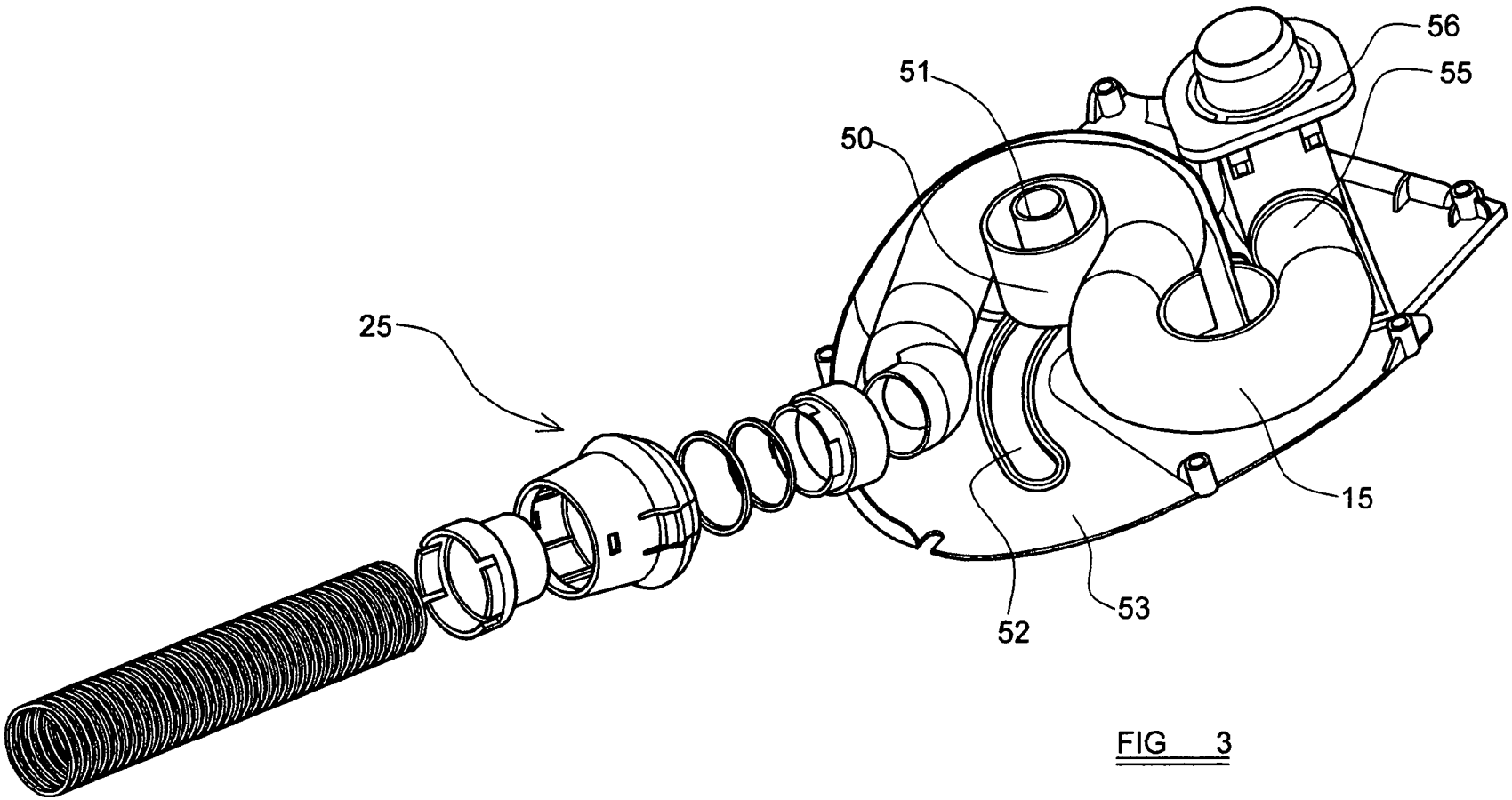
FIG. 3 is a diagrammatic perspective view of part of a further embodiment of a suction cleaner in accordance with the invention.

Referring now to FIG. 3 of the drawings, this shows an alternative arrangement for guiding the first hose portion 15 to cause it to assume its generally S-shaped configuration when fully contracted and accommodated within the storage volume of the cleaner. Instead of the spring loaded pivoted arm 20, a guide formation in the form of a roller 50 is rotatably carried by a member 51 which is mounted for sliding a movement along an arcuate slot 52 provided in a member 53 forming a base of the hose-storage chamber of the cleaner. A spring operates on the roller assembly 50, 51 to bias it towards the end of the slot 52 in which it is shown in the drawing, and the spring is arranged to provide an increase in the spring load applied to the roller assembly as the latter moves to the opposite end of the slot as the first hose portion is deployed from the storage chamber. Any suitable spring arrangement may be provided for achieving this, e.g. a coiled tension spring arranged so that its geometry alters as they roll assembly moves along the slot.

FIG. 3 also depicts the connection arrangement 25 as described above in relation to FIG. 2, and the way in which the end 55 of the first hose portion 15, removed from the connector assembly 25, is fixed to the base 53 and to an outlet elbow which, in the suction cleaner, leads to the separator/collector arrangement of the cleaner and thence to the source of suction.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A suction cleaner comprising:

a suction unit for creating a flow of air for drawing in dirt;

a flexible suction hose leading from the suction unit and having a hose inlet at which the suction air flow may be drawn in, the suction hose comprising a first hose portion and a second hose portion having a connection to the first hose portion, the second hose portion having the hose inlet;

wherein the suction unit includes a body that affords a storage volume for accommodating the first hose portion when it is in a contracted condition, and from which the first hose portion can be deployed when required, and wherein the suction unit has at least one guide formation for causing the first portion of the hose to assume a generally S shaped configuration within the storage volume, the guide formation including a first roller rotatable about a first axis that is fixed with respect to the body, and a second roller rotatable about a second axis, the second axis movable along a circular arc centered on the first axis.

2. A suction cleaner according to claim 1 wherein said guide formation is movable in an arcuate path within the storage volume.

3. A suction cleaner according to claim 1 wherein said guide formation is spring biased in its movement to cause the first hose portion to assume the S-shaped configuration.

4. A suction cleaner according to claim 1 wherein the connection of the first hose portion to the second hose portion is releasably connectable to a body part of the suction unit when the first hose portion is accommodated in the storage volume of the suction unit.

5. A suction cleaner according to claim 4 wherein the connection of the first hose portion to the second hose portion provides for release of the second hose portion from the first hose portion.

6. A suction cleaner according to claim 1 wherein the first hose portion is extendible lengthwise when subject to lengthways tension, the second hose portion being substantially inextendible.

7. A suction cleaner comprising:

a suction unit for creating a flow of air;

a flexible suction hose having a hose inlet at which air may be inducted into the suction hose, the suction hose leading from the suction unit comprising a first hose portion and a second hose portion having a connection to the first hose portion, the second hose portion having the hose inlet;

the suction unit including a body that at least partially defines a storage volume in which the first hose portion can be accommodated when the first hose portion is in a contracted condition, and from which the first hose portion can be deployed when required;

a first roller rotatable about a first axis that is fixed with respect to the body;

an arm pivotable about the first axis;

a second roller rotatable about a second axis, the second axis fixed with respect to the arm such that the second axis moves along a circular arc around the first axis, the first hose portion positioned to engage each of the first roller and the second roller such that assumes a generally sinuous configuration when accommodated in the storage volume.

8. A suction cleaner according to claim 7 wherein the first hose portion is extendible lengthwise when subject to lengthways tension, the second hose portion being substantially inextendible.

9. A suction cleaner comprising:

a suction unit for creating a flow of air for drawing in dirt;

a flexible suction hose leading from the suction unit and having a hose inlet at which the suction air flow may be drawn in, the suction hose comprising a first hose portion and a second hose portion having a connection to the first hose portion, the second hose portion having the hose inlet;

the suction unit including a body that affords a storage volume for accommodating the first hose portion when it is in a contracted condition, and from which a required part of the first hose portion can be deployed, the body at least partially defining a slot;

a first roller positioned within the body and supported on a first axis that is fixed with respect to the body; and a second roller positioned within the body and supported on a second axis, the second axis movable along the slot, the first roller and the second roller cooperating to support the first hose portion in the contracted condition.

10. A suction cleaner according to claim 9 wherein the first hose portion is extendible lengthwise when subject to lengthways tension, the second hose portion being substantially inextendible.

11. A suction cleaner according to claim 9 wherein the first roller is rotatable about the first axis and the second roller is rotatable about the second axis.

* * * * *

UNITED STATES PATENT AND TRADEMARK OFFICE

CERTIFICATE OF CORRECTION

PATENT NO. : 7,631,396 B2
APPLICATION NO. : 11/018552
DATED : December 15, 2009
INVENTOR(S) : Ivarsson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1312 days.

Signed and Sealed this

Second Day of November, 2010

David J. Kappos

David J. Kappos
*Director of the United States Patent and Trademark Office*